US011739577B2

(12) United States Patent
Duer et al.

(10) Patent No.: US 11,739,577 B2
(45) Date of Patent: Aug. 29, 2023

(54) FURNITURE HINGE

(71) Applicant: Julius Blum GmbH, Hoechst (AT)

(72) Inventors: Stefan Duer, Schwarzach (AT); André Hammerer, Alberschwende (AT); Rainer Hollenstein, Lustenau (AT)

(73) Assignee: Julius Blum GmbH, Hoechst (AT)

( * ) Notice: Subject to any disclaimer, the term of this patent is extended or adjusted under 35 U.S.C. 154(b) by 185 days.

(21) Appl. No.: 17/318,295

(22) Filed: May 12, 2021

(65) Prior Publication Data

US 2021/0262258 A1 Aug. 26, 2021

Related U.S. Application Data

(63) Continuation of application No. PCT/AT2019/060367, filed on Nov. 5, 2019.

(30) Foreign Application Priority Data

Nov. 13, 2018 (AT) ..... A 50977/2018

(51) Int. Cl.
*E05D 3/06* (2006.01)
*E05D 3/16* (2006.01)
*E05D 15/26* (2006.01)

(52) U.S. Cl.
CPC ..... *E05D 3/16* (2013.01); *E05D 15/264* (2013.01); *E05D 2003/166* (2013.01); *E05Y 2900/212* (2013.01)

(58) Field of Classification Search
CPC ..... Y10T 16/547; Y10T 16/5475; Y10T 16/5476; Y10T 16/551; E05D 15/264;
(Continued)

(56) References Cited

U.S. PATENT DOCUMENTS 2,144,977 A 6/1939 Jacob
2,674,761 A 4/1954 Weiss
(Continued)

FOREIGN PATENT DOCUMENTS

AT 517343 1/2017
AT 519479 7/2018
(Continued)

OTHER PUBLICATIONS

Search Report dated Mar. 22, 2022 in corresponding Chinese Patent Application No. 201980074747.2.
(Continued)

*Primary Examiner* — Chuck Y Mah
(74) *Attorney, Agent, or Firm* — Wenderoth, Lind & Ponack, L.L.P.

(57) ABSTRACT

A furniture hinge includes a first fitting portion to be fixed to a furniture part or a carrier movably-supported relative to a furniture carcass, a second fitting portion to be fixed to a movably-supported furniture part, and a hinge mechanism connecting the fitting portions. The hinge mechanism has a least five hinge axis members, and includes a supporting lever directly connecting the fitting portions. The hinge mechanism includes a control mechanism for controlling a motion sequence between the first and second fitting portions. The control mechanism is separate from (i.e., is not constructed as one piece with) the supporting lever and has at least three control levers hingedly connected together. A first control lever is connected to the first fitting portion via a hinge axis member, a second control lever is connected to the second fitting portion via a hinge axis member, and a third control lever connects the first control lever and the second control lever.

20 Claims, 8 Drawing Sheets

(58) Field of Classification Search
CPC ..... E05D 15/34; E05D 15/28; E05D 15/30; E05D 15/32; E05D 3/06; E05D 3/08; E05D 3/14; E05D 3/16; E05D 2003/166; E06B 7/36; E06B 7/367; E05Y 2900/20; E05Y 2900/212
See application file for complete search history.

(56) References Cited

U.S. PATENT DOCUMENTS

| | | | | |
|---|---|---|---|---|
| 4,564,975 | A | 1/1986 | Kuffner | |
| 7,797,796 | B2 | 9/2010 | Migli | |
| 7,861,376 | B2 | 1/2011 | Fitz et al. | |
| 8,007,026 | B2 * | 8/2011 | Scott | E05D 3/127 296/146.12 |
| 8,303,056 | B2 | 11/2012 | Giorgi | |
| 10,041,283 | B2 * | 8/2018 | Zetti | E05F 3/20 |
| 10,676,974 | B2 * | 6/2020 | Wojdyla | A61G 3/062 |
| 10,753,133 | B2 | 8/2020 | Kohlweiss | |
| 2007/0251058 | A1 | 11/2007 | Fitz et al. | |
| 2008/0172833 | A1 | 7/2008 | Migli | |
| 2010/0117500 | A1 | 5/2010 | Giorgi | |
| 2018/0119470 | A1 | 5/2018 | Kohlweiss | |
| 2019/0330898 | A1 | 10/2019 | Rupp et al. | |
| 2020/0018107 | A1 | 1/2020 | Rupp et al. | |

FOREIGN PATENT DOCUMENTS

| | | | |
|---|---|---|---|
| AT | 519513 | | 7/2018 |
| CN | 101187277 | | 5/2008 |
| CN | 107735542 | | 2/2018 |
| DE | 643 260 | | 4/1937 |
| DE | 2361748 | A1 * | 6/1975 |
| DE | 2406439 | A1 * | 8/1975 |
| DE | 197 09 461 | | 9/1998 |
| DE | 20 2005 021 892 | | 1/2011 |
| GB | 758932 | | 10/1956 |
| JP | 2000-310080 | | 11/2000 |
| JP | 3195311 | | 8/2001 |
| JP | 2004-137789 | | 5/2004 |
| TW | 201829897 | | 8/2018 |
| TW | 201829899 | | 8/2018 |
| WO | 2006/053364 | | 5/2006 |
| WO | 2007/148366 | | 12/2007 |
| WO | 2014/154252 | | 10/2014 |
| WO | 2017/000006 | | 1/2017 |
| WO | 2018/129568 | | 7/2018 |
| WO | 2018/129574 | | 7/2018 |

OTHER PUBLICATIONS

International Search Report dated Jan. 31, 2020 in International (PCT) Application No. PCT/AT2019/060367.

* cited by examiner

FURNITURE HINGE

BACKGROUND OF THE INVENTION

The present invention relates to a furniture hinge including: a first fitting portion to be fixed to a furniture part or to a carrier movably-supported relative to a furniture carcass, a second fitting portion to be fixed to a movably-supported furniture part, and a hinge mechanism for hingedly connecting the first fitting portion and the second fitting portion to one another, in which the hinge mechanism having a least five, preferably at least seven, hinge axis members. The hinge mechanism includes at least one supporting lever directly connecting the first fitting portion and the second fitting portion to one another, and includes a control mechanism for controlling a motion sequence between the first fitting portion and the second fitting portion. The control mechanism is separate from the at least one supporting lever and has at least three control levers hingedly connected to one another.

Moreover, the invention relates to a guide system for guiding at least one movably-supported furniture part, the guide system comprising a furniture hinge of the type to be described.

Further, the invention concerns an item of furniture comprising a furniture carcass, at least one furniture part movably-supported relative to the furniture carcass, and a furniture hinge or a guide system for moving the at least one furniture part.

WO 2006/053364 A1 to the present applicant discloses a furniture hinge configured as a wide-angle hinge. For obtaining a maximum opening angle of approximately 170°, a relatively complex construction is required. With the aid of an intermediate portion serving as an extension of the hinge arm and being coupled to a movement of the hinge, it is possible that the furniture parts can not only be pivoted relative to one another, but can also enlarge their distance to one another upon pivoting.

U.S. Pat. No. 2,674,761 A discloses a hinge for refrigerator doors. The hinge includes a first fitting portion in the form of a first mounting plate and a second fitting portion in the form of a second mounting plate hingedly connected therewith. The hinge is configured as a multiple-joint hinge having seven hinge axes, and the hinge includes a supporting lever (reference number 8) directly connecting the fitting portions configured to be fixed to the furniture parts. The supporting lever has a reinforced configuration and is formed by a stack of eight plates bearing against one another. In addition to the supporting lever, further levers are provided for connecting the fitting portions to one another. A drawback is the fact that the construction requires a relatively large installation space, and that the hinge can only be used for applications in which the maximum opening angle of the door is limited to approximately 90°.

GB 758,932 A discloses a multiple-joint hinge having seven hinge axis members, and a supporting lever (reference number 3) directly connects a fitting portion configured to be fixed to a carcass and a hinge axis member arranged within a material thickness of the door.

WO 2007/148366 A1 discloses an item of furniture with two movable door wings which are hingedly connected to one another via a vertically extending axis. By a guide system, the door wings are movable relative to one another between a coplanar position and a parallel position. In the parallel position, the door wings can be stored within a lateral insertion compartment of the furniture carcass.

The coupling of the two fitting portions with furniture hinges having five or more hinge axes for enlarging a maximum opening angle of the furniture hinge is usually implemented by two or more levers which are hingedly connected to the first fitting portion as well as to the second fitting portion. Two of these levers are pivotally connected to one another by a hinge axis member separate from the fitting portions. When the furniture hinge is heavily loaded, the fitting portions sag relative to one another, whereby the friction is increased and the movement behavior of the movable furniture part is negatively affected.

SUMMARY OF THE INVENTION

It is an object of the present invention to propose a furniture hinge mentioned in the introductory part, thereby avoiding the above-discussed drawbacks.

According to the invention, a first control lever is connected to the first fitting portion via a hinge axis member, a second control lever is connected to the second fitting portion via a hinge axis member, and a third control lever connects the first control lever and the second control lever to one another.

According to the invention, a furniture hinge having five or more hinge axis members, at least one pivotable supporting lever is provided. The at least one supporting lever directly connects the first fitting portion and the second fitting portion of the furniture hinge in a hinged manner (that is to say without interposing a further hinge lever). In this way, the loading capacity of the furniture hinge can be increased, the stability can be improved and the maximum opening angle can be enlarged.

Besides an improved stiffness and a reduced sagging movement of the furniture hinge, a further advantage of the invention lies in the fact that the at least one supporting lever bears the main load of the furniture hinge. Therefore, a control mechanism, which is a separate component from (i.e., does not have a one-piece construction with) the supporting lever for controlling a motion sequence between the first fitting portion and the second fitting portion, does practically not have to assume a supporting function. That control mechanism separate from the supporting lever can therefore be configured significantly more filigree, while maintaining the stability. The control levers of the control mechanism can be formed, for example, by a thinner material, whereby the furniture hinge can be configured more compact and can also be produced in a less expensive manner due to the filigree construction of the control mechanism.

According to the invention, the control mechanism for controlling a motion sequence between the first fitting portion and the second fitting portion includes at least three control levers hingedly connected to one another. The first control lever is connected to the first fitting portion via a hinge axis member, and a second control lever is connected to the second fitting portion via a hinge axis member. The third control lever connecting the first control lever and the second control lever to one another can be pivotally connected to the at least one supporting lever via a hinge axis member.

Preferably, all hinge axis members of the furniture hinge, in a mounted condition of the furniture hinge on the movable furniture part, preferably in all operating positions of the furniture hinge, are arranged outside a material thickness of the movable furniture part. This has the particular advantage that the second fitting portion can be simply fixed to the movable furniture part, without the necessity that laborious recesses or bores for receiving the second furniture part must be provided in the movable furniture part.

BRIEF DESCRIPTION OF THE DRAWINGS

Further details and advantages of the invention result from the following description of figures.

DETAILED DESCRIPTION OF THE INVENTION

Figure 1A:
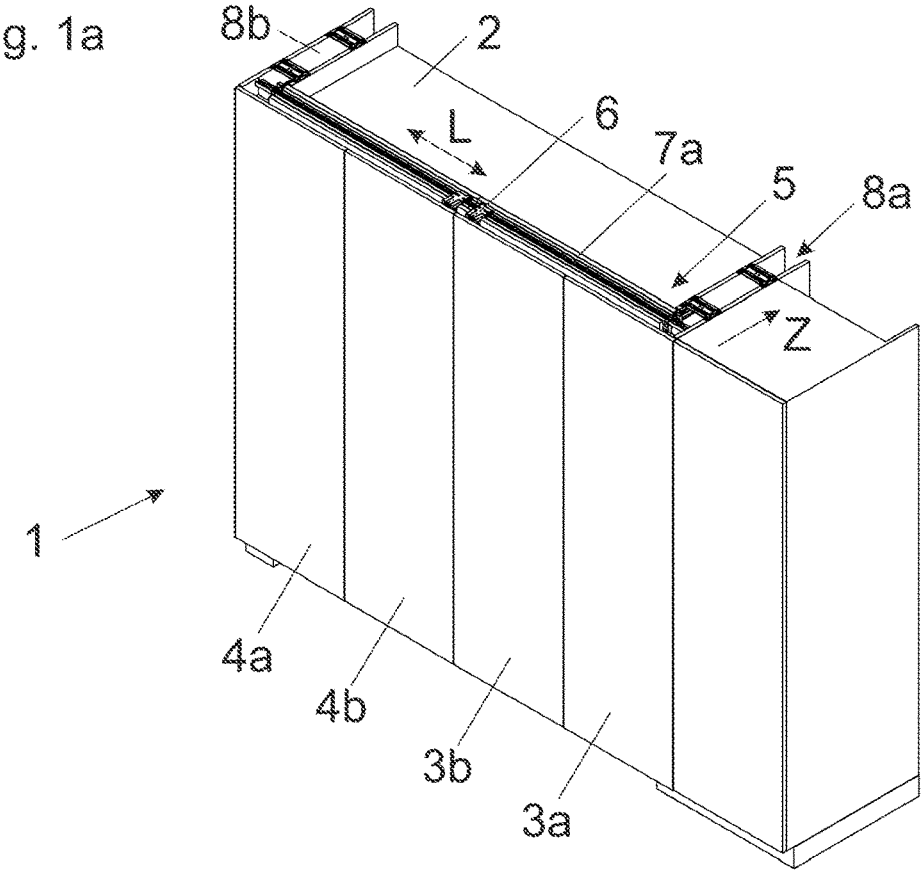
FIG. 1*a*, 1 *b* are perspective views of an item of furniture comprising a furniture carcass and furniture parts configured to be movable relative thereto.

FIG. 1*a* shows a perspective view of an item of furniture 1 comprising a furniture carcass 2 and furniture parts 3*a*, 3*b*; 4*a*, 4*b* which are movable relative to the furniture carcass 2, the furniture parts 3*a*, 3*b*; 4*a*, 4*b* being in the form of panel-shaped door wings. Each of the furniture parts 3*a*, 3*b* and the furniture parts 4*a*, 4*b* are movably supported by a guide system 5 between a first position, in which the furniture parts 3*a*, 3*b*; 4*a*, 4*b* are aligned substantially coplanar to one another, and a second position, in which the furniture parts 3*a*, 3*b*; 4*a*, 4*b* are aligned substantially parallel to one another. In the second (parallel) position, the furniture parts 3*a*, 3*b* can be inserted into a lateral receiving compartment 8*a* of the furniture carcass 2, whereas the furniture parts 4*a*, 4*b*, in a parallel position to one another, can be inserted into a further receiving compartment 8*b*. The functionality will be explained in the following with the aid of the furniture parts 3*a* and 3*b*, and the same explanations apply to the furniture parts 4*a*, 4*b*. The guide system 5 includes a first guide rail 7*a* having a longitudinal direction (L), and a guide carriage 6 configured to be connected to the second furniture part 3*b* is displaceably supported along the first guide rail 7*a*.

Figure 1B:
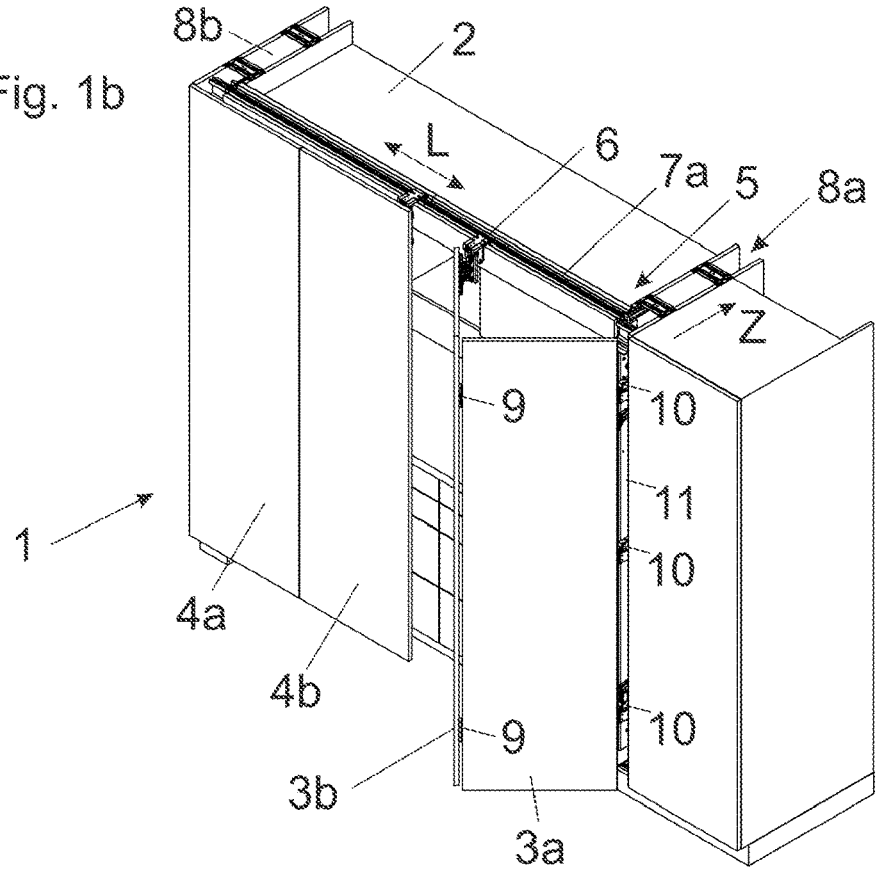

FIG. 1*b* shows the item of furniture 1, in which the furniture parts 3*a*, 3*b* have been moved from the coplanar position shown in FIG. 1*a* into an angled position relative to one another. The first furniture part 3*a* is supported on a carrier 11 via two or more furniture hinges 10, the carrier 11 being configured to be inserted in a depth direction (Z) into the receiving compartment 8*a*. In the shown figure, the carrier 11 is located in a transfer position in which the carrier 11 adjoins the first guide rail 7*a* in the longitudinal direction (L), so that the guide carriage 6 can be transferred to and from between the first guide rail 7*a* and the carrier 11. In the shown transfer position, the carrier 11 is releasably locked to the first guide rail 7*a*. The locking between the first guide rail 7*a* and the carrier 11 can be released by an entry of the guide carriage 6 in or on the carrier 11. The carrier 11 is in the form of a longitudinal column, a length of which corresponding to at least half of a height of the furniture part 3*a*, 3*b*. The two furniture parts 3*a*, 3*b* are hingedly connected to one another about a vertically extending axis by a hinge fitting 9. The second furniture part 3*b* is displaceably supported along the first guide rail 7*a* via the guide carriage 6.

Figure 2A:
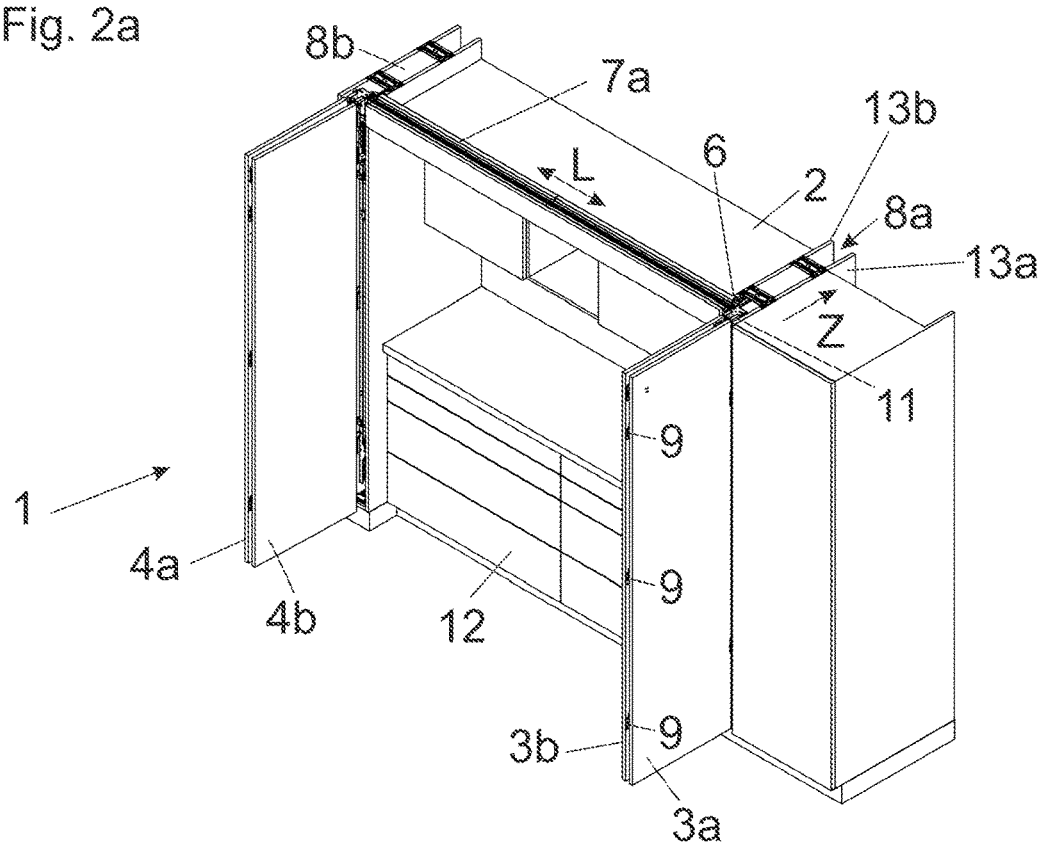
FIG. 2*a*, 2*b* show the item of furniture according to FIGS. 1*a*, 1*b* in further positions of the furniture parts to one another.

FIG. 2*a* shows the item of furniture 1 with the furniture parts 3*a*, 3*b* which are now aligned parallel to one another. The carrier 11 has been unlocked from the first guide rail 7*a* by an entry of the guide carriage 6, so that the carrier 11 (jointly with the guide carriage 6 and the furniture parts 3*a*, 3*b*) can be inserted into the receiving compartment 8*a* in the depth direction (Z), for example along a second guide rail (not shown) of the guide system 5, the second guide rail extending transversely to the longitudinal direction (L).

Figure 2B:
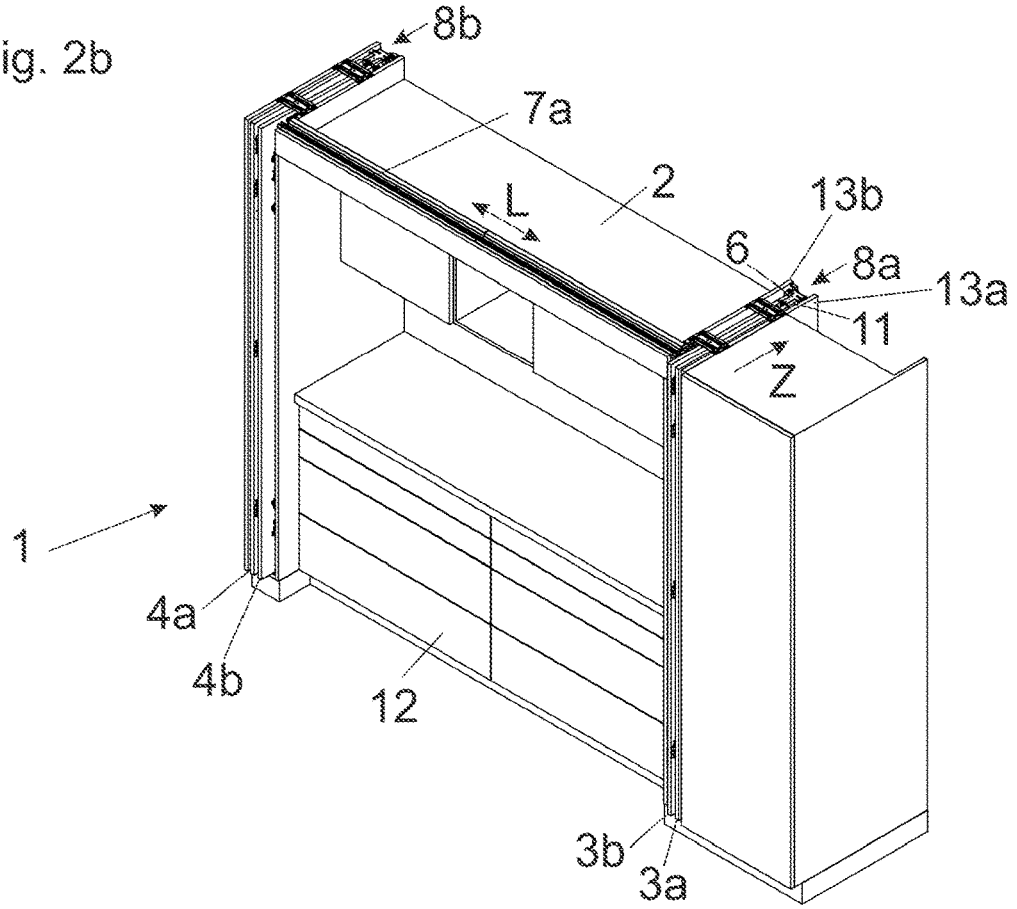

FIG. 2*b* shows the item of furniture 1 with the furniture parts 3*a*, 3*b* which are now located in a fully inserted position within the receiving compartment 8*a*. The furniture parts 3*a*, 3*b* are thus movable by the guide system 5 from a first position according to FIG. 1*a*, in which the furniture parts 3*a*, 3*b* are aligned substantially coplanar to one another, into a second position according to FIG. 2*b*, in which the furniture parts 3*a*, 3*b* are aligned substantially parallel to one another and received within the receiving compartment 8*a*. In this way, for example, a kitchen 12 as shown in FIG. 2*a*, 2*b* can be entirely covered, so that the kitchen 12 can be visually separated from the remaining area of a living room. The receiving compartment 8*a*, in the shown embodiment, is formed by a sidewall 13*a* and a partition wall 13*b* spaced in a parallel relationship from the sidewall 13*a*. The furniture parts 3*a*, 3*b* can be inserted between the sidewall 13*a* and the partition wall 13*b* when aligned in a parallel position to one another.

Figure 3:
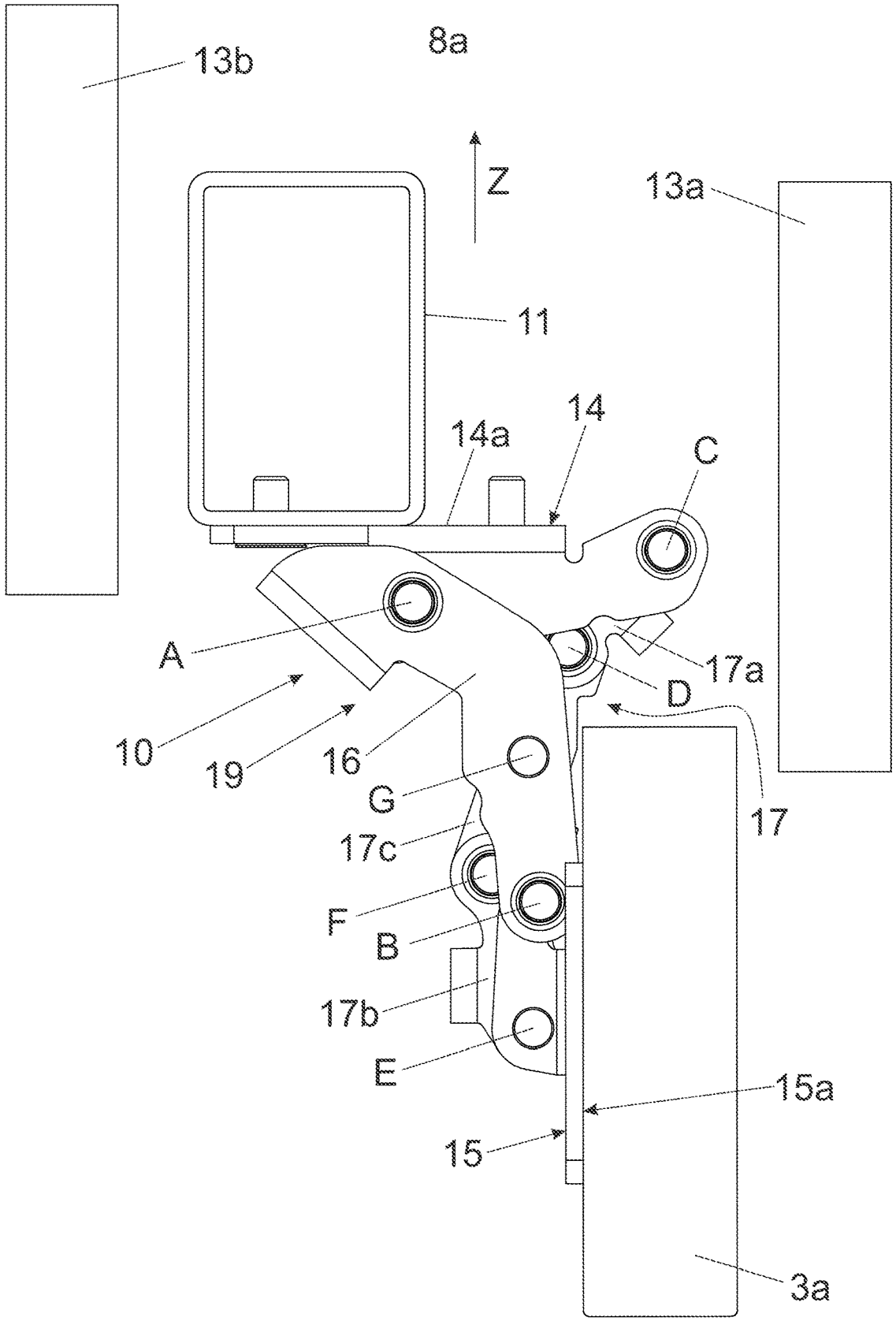
FIG. 3 is a cross-sectional view of the furniture hinge, in which the furniture part is aligned parallel to a sidewall of the furniture carcass.

FIG. 3 shows a cross-sectional view of the carrier 11 arranged between the sidewall 13*a* and the partition wall 13*b*, and this depiction corresponds to the position of the furniture parts 3*a*, 3*b* shown in FIG. 2*a*. The carrier 11 is configured to be inserted into the receiving compartment 8*a* in the depth direction (Z). In the shown figure, the carrier 11 is formed by a longitudinal hollow profile. At least one furniture hinge 10 is provided for the pivotal connection between the carrier 11 and the first furniture part 3*a*. The at least one furniture hinge 10 includes a first fitting portion 14 configured to be fixed to the carrier 11 and a second fitting portion 15 configured to be fixed to the furniture part 3*a*. The first fitting portion 14 can either be fixed to the shown carrier 11, or, alternatively, to another furniture part (for example to the sidewall 13*a* or to the partition wall 13*b*). For fixing purposes, the first fitting portion 14 and/or the second fitting portion 15 can include at least one fastening location 18. For example, the at least one fastening location 18 can be configured as a hole for receiving screws 21 (FIG. 7) or as a, preferably expandable, dowel.

Figure 5:
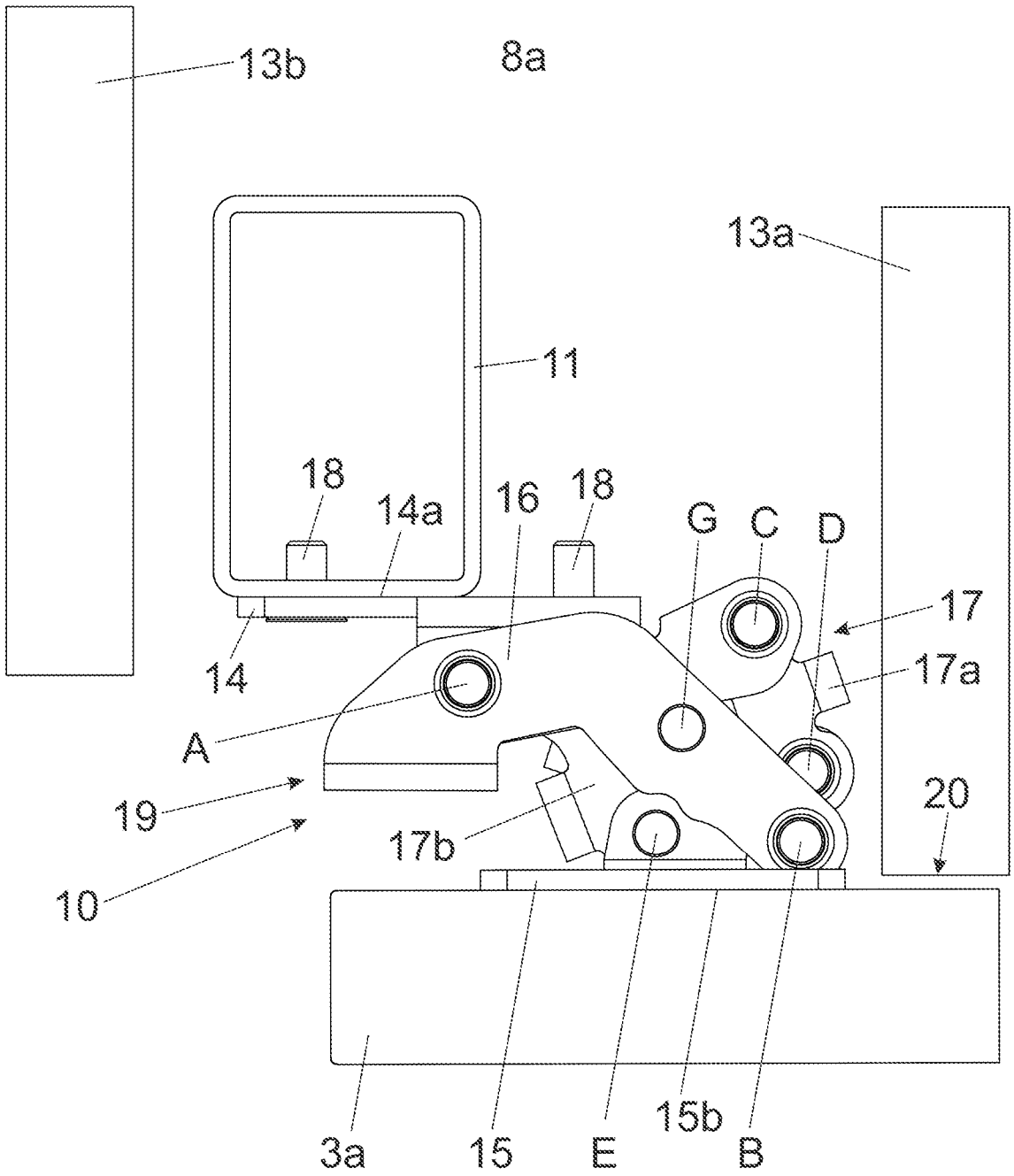
FIG. 5 is a cross-sectional view of the furniture hinge, in which the furniture part is aligned perpendicular to a sidewall of the furniture carcass.

The first fitting portion 14 includes a flat-shaped first bearing surface 14*a* configured to bear against the carrier 11 or against a furniture part (for example against the sidewall 13*a* or against the partition wall 13*b*), whereas the second fitting portion 15 is provided with a flat-shaped second bearing surface 15*a*. The two fitting portions 14, 15 are movably supported relative to one another between a first position, in which the bearing surfaces 14*a*, 15*a* are arranged substantially perpendicular to one another (FIG. 3), and a second position, in which the bearing surfaces 14*a*, 15*a* are arranged substantially parallel to one another (FIG. 5).

The furniture hinge 10 includes hinge mechanism 19 for hingedly connecting the first fitting portion 14 and the second fitting portion 15 to one another, the hinge mechanism 19 including at least five, preferably at least seven, hinge axis members (A, B, C, D, E, F, G). Moreover, the hinge mechanism 19 includes at least one supporting lever 16 directly connecting the first fitting portion 14 and the second fitting portion 15 to one another. The supporting lever 16 is thus directly connected to the first fitting portion 14 via a first hinge axis member (A) and directly connected to the second fitting portion 15 by a second hinge axis member (B), the supporting lever 16 bearing the major load of the furniture hinge 10. By a control mechanism 17 being a separate component from the supporting lever 16 (i.e., not having a one-piece construction with the supporting lever 16), a motion sequence between the first fitting portion 14 and the second fitting portion 15 can be controlled. The control mechanism 17 includes at least three pivotable control levers 17*a*, 17*b*, 17*c*. A first control lever 17*a* is connected to the first fitting portion 14 via a third hinge axis member (C), and is connected to a third control lever 17*c* via a fourth hinge axis member (D). The third control lever 17*c* is pivotally supported on the supporting lever 16 via a seventh hinge axis member (G). A second control lever 17*b* is hingedly connected to the second fitting portion 15 via a fifth hinge axis member (E), and to the third control lever 17*c* via a sixth hinge axis (F).

Preferably, all hinge axis members (A, B, C, D, E, F, G) of the furniture hinge 10, in a mounted condition of the furniture hinge 10 on the movable furniture part 3*a*, preferably in all operating positions of the furniture hinge 10, are arranged outside a material thickness of the movable furniture part 3*a*.

Figure 4:
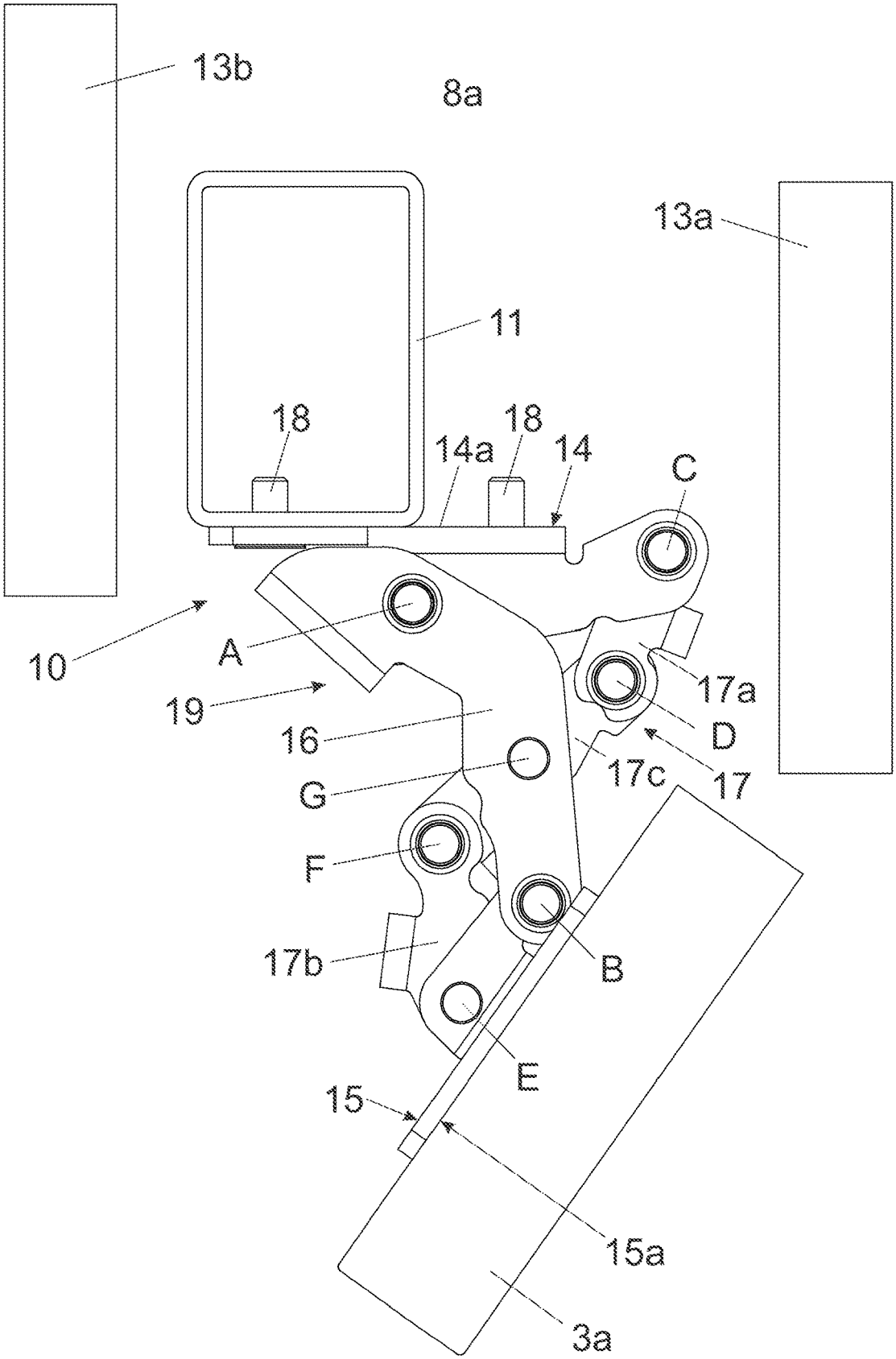
FIG. 4 is a cross-sectional view of the furniture hinge, in which the furniture part adopts an angled position relative to the sidewall of the furniture carcass.

FIG. 4 shows a further movement of the first fitting portion 14 and the second fitting portion 15 relative to one another, and the position of the first furniture part 3*a* approximately corresponds to FIG. 1*b*. Easily seen is the supporting lever 16 which is directly connected to the first fitting portion 14 via the first hinge axis member (A) and directly connected to the second fitting portion 15 via the second hinge axis member (B). The third control lever 17*c* is connected to the supporting lever 16 via the seventh hinge axis member (G). A first lever end of the third control lever 17*c* is connected to the first control lever 17*a* via the fourth hinge axis member (D). A second lever end of the third control lever 17*c* is connected to the second control lever 17*b* via the sixth hinge axis member (F). According to an embodiment, the supporting lever 16 is at least partially curved-shaped along a longitudinal extension of the supporting lever 16. It can be seen that the at least one supporting lever 16, via the hinge axis member (B), and the second control lever 17*b*, via the hinge axis member (E), are jointly supported on the second fitting portion 15.

FIG. 5 shows a further movement of the first fitting portion 14 and the second fitting portion 15 to one another, and the position of the first furniture part 3*a* corresponds to FIG. 1*a* in which the furniture parts 3*a*, 3*b* are aligned substantially coplanar to one another. It can be seen that the control mechanism 17 of the furniture hinge 10 is configured such that the first furniture part 3*a* at least partially, preferably substantially entirely, covers a front face 20 of the sidewall 13*a*. In this way, when viewing the item of furniture 1 from the front, an overall smooth surface can be provided, without the formation of a step or a gap between the sidewall 13*a* and the movable furniture part 3*a* to be seen from the front.

Figure 6:
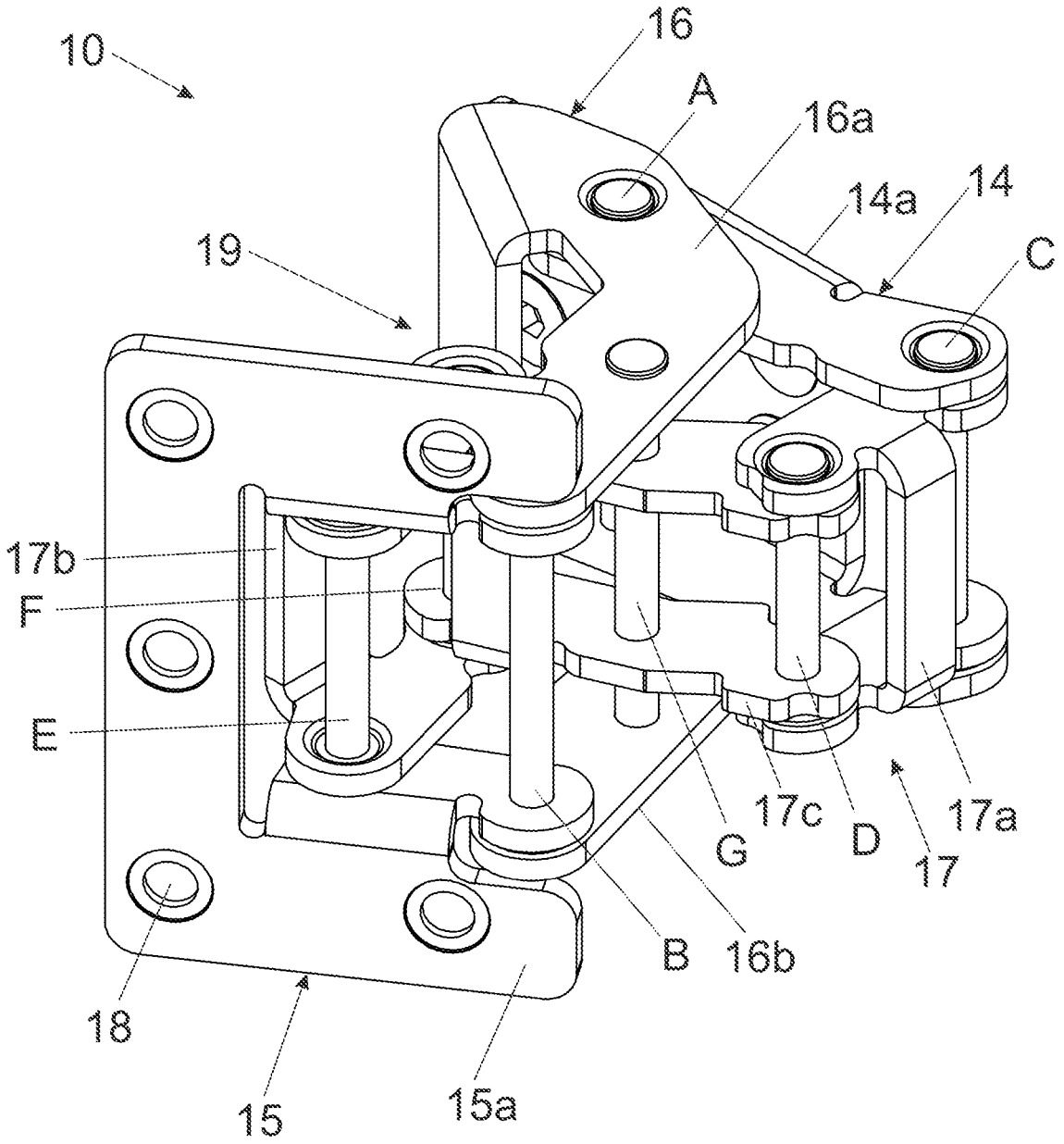
FIG. 6 shows the furniture hinge in a perspective view.

FIG. 6 shows the furniture hinge 10 in a perspective view. According to an embodiment, the at least one supporting lever 16 includes at least two partial levers 16*a*, 16*b* which are spaced from one another along the hinge axis members (A, B, C, D, E, F, G). In this way, a stable construction can be provided which is, in particular, suitable for supporting heavy furniture parts 3*a*.

According to a further embodiment, at least one of the control levers 17*a*, 17*b*, 17*c*, preferably all control levers 17*a*, 17*b*, 17*c*, is or are at least partially arranged within the partial levers 16*a*, 16*b* of the supporting lever 16, and/or that at least one of the control levers 17*a*, 17*b*, 17*c*, preferably all control levers 17*a*, 17*b*, 17*c*, includes or include at least two partial levers which are spaced from one another along the hinge axis members (A, B, C, D, E, F, G).

Figure 7:
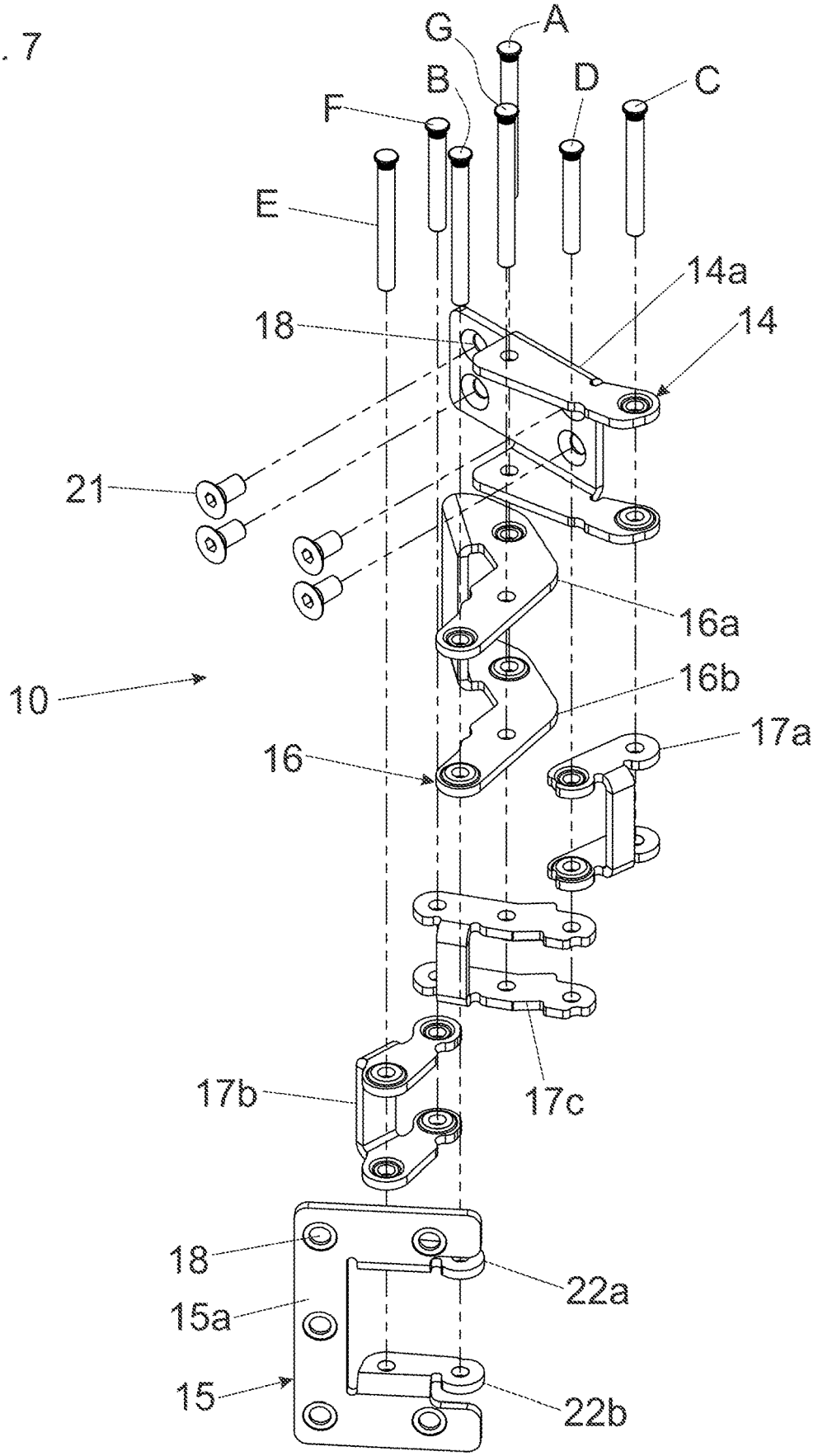
FIG. 7 shows the furniture hinge in an exploded view.

FIG. 7 shows the furniture hinge 10 in an exploded view. In order to improve the stability of the furniture hinge 10, as shown in the figure, the supporting lever 16 and/or at least one control lever 17*a*, 17*b*, 17*c*, preferably all control levers 17*a*, 17*b*, 17*c*, can include at least two pivot bearings for receiving the hinge axis members (A, B, C, D, E, F, G), the pivot bearings being spaced from one another along the hinge axis members (A, B, C, D, E, F, G). Thereby, the hinge axis members (A, B, C, D, E, F, G) are supported in these pivot bearings so as to be rotatable and/or limitedly displaceable.

The second fitting portion 15 includes at least one limb 22*a*, 22*b* protruding transversely, preferably at a right angle, from the bearing surface 15*a* of the second fitting portion 15. The at least one limb 22*a*, 22*b* is provided for supporting the supporting lever 16, in the present case for supporting the two partial levers 16*a*, 16*b* of the supporting lever 16 on the two hinge axis members (B, E).

Figure 8A:
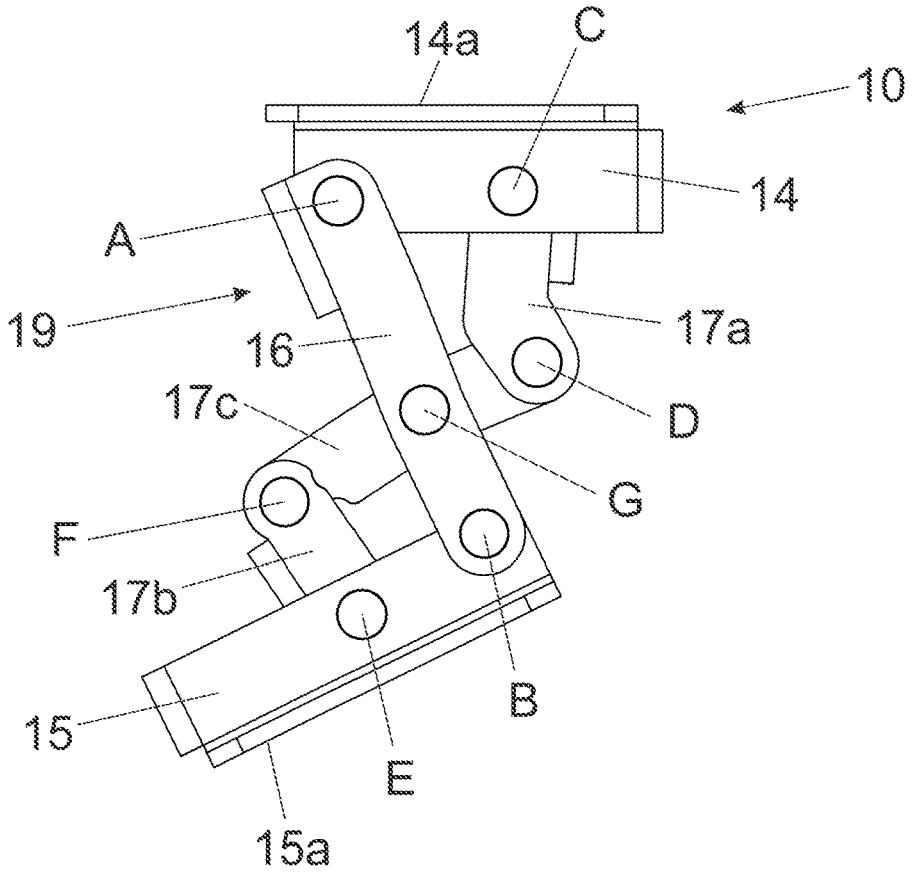
FIG. 8*a*, 8*b* shows the furniture hinge according to a further embodiment in a top view and in a perspective view.

FIG. 8*a* shows a top view onto a furniture hinge 10 according to a further embodiment. Again, this is a furniture hinge 10 having seven hinge axis members (A, B, C, D, E, F, G), and the supporting lever 16 of the hinge mechanism 19 is directly connected to both the first fitting portion 14 via the hinge axis member (A) and to the second fitting portion 15 via the hinge axis member (B). The first fitting portion 14 is configured to be fixed to the carrier 11, whereas the second fitting portion 15 is configured to be fixed to the furniture part 3*a*.

Figure 8B:
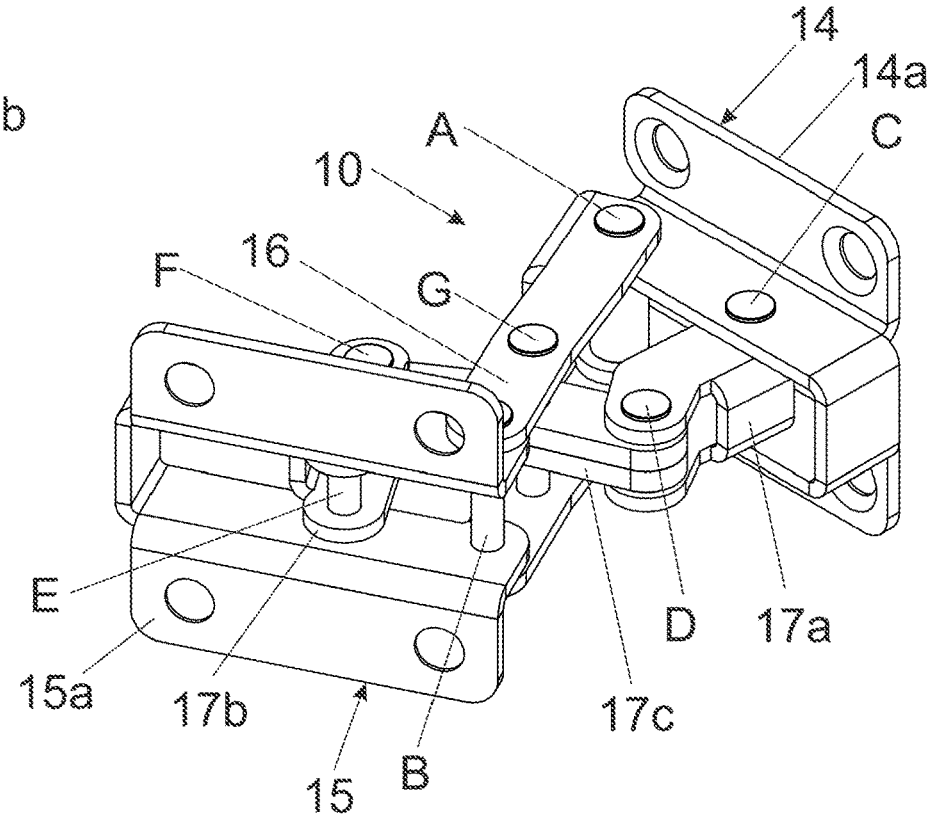

This embodiment differs from the previous embodiment by a deviating position of the hinge axis members (A, B, C, D, E, F, G), by a deviating shape of the supporting lever 16 and by a deviating shape of the control levers 17*a*, 17*b*, 17*c*. The supporting lever 16 is thereby configured substantially straight, whereas the control lever 17*a* has an angled shape. FIG. 8*b* shows the embodiment according to FIG. 8*a* in a perspective view. This embodiment is, in particular, also suitable to move one single furniture part 3*a* relative to the furniture carcass 2.

The invention claimed is:

1. A furniture hinge comprising:

a first fitting portion configured to be fixed to a furniture part or configured to be fixed to a carrier movably-supported relative to a furniture carcass;

a second fitting portion configured to be fixed to a movably-supported furniture part;

a hinge mechanism for hingedly connecting the first fitting portion and the second fitting portion to one another, the hinge mechanism having at least five hinge axis members, wherein the hinge mechanism includes a supporting lever directly connecting the first fitting portion and the second fitting portion to one another, wherein the hinge mechanism includes a control mechanism for controlling a motion sequence between the first fitting portion and the second fitting portion, the control mechanism being a separate component from the supporting lever so as to not have a one-piece construction with the supporting lever, and the control mechanism having at least three control levers hingedly connected to one another, wherein the at least three control levers of the control mechanism include a first control lever connected to the first fitting portion via a hinge axis member, a second control lever connected to the second fitting portion via a hinge axis member, and a third control lever connecting the first control lever and the second control lever to one another, and wherein the supporting lever includes at least two pivot bearings for receiving the hinge axis members, the at least two pivot bearings being spaced from one another along a hinge axis member.

2. The furniture hinge according to claim 1, wherein the supporting lever is pivotally connected to the first fitting portion via a first hinge axis member of the at least five hinge axis members, and is pivotally connected to the second fitting portion via a second hinge axis member of the at least five hinge axis members.

3. The furniture hinge according to claim 1, wherein the supporting lever is at least partially curved-shaped along a longitudinal extension of the supporting lever.

4. The furniture hinge according to claim 1, wherein the first fitting portion and/or the second fitting portion includes or include a fastening location for fixing the first fitting portion and/or the second fitting portion to a furniture part.

5. The furniture hinge according to claim 1, wherein the at least five hinge axis members, in a mounted condition of the furniture hinge, extend substantially vertically.

6. The furniture hinge according to claim 1, wherein the third control lever is pivotally connected to the supporting lever via a hinge axis member of the at least five hinge axis members.

7. The furniture hinge according to claim 1, wherein all of the at least five hinge axis members, in a mounted condition of the furniture hinge on a movable furniture part are arranged outside a material thickness of the movable furniture part.

8. The furniture hinge according to claim 7, wherein all of the at least five hinge axis members are arranged outside the material thickness of the movable furniture part in all operating positions of the furniture hinge.

9. The furniture hinge according to claim 1, wherein the supporting lever, via a first one of the at least five hinge axis members, and the second control lever, via a second one of the at least five hinge axis members, are jointly supported on the second fitting portion.

10. The furniture hinge according to claim 1, wherein the hinge mechanism has at least seven hinge axis members.

11. A guide system for guiding a furniture part movably-supported relative to a sidewall of a furniture carcass, the guide system comprising:

a carrier configured to be displaceably supported, in a mounted condition, relative to the furniture carcass in a depth direction of the sidewall, a furniture hinge for movably supporting the at least one furniture part relative to the furniture carcass, the furniture hinge including:

a first fitting portion;

a second fitting portion, the first fitting portion being configured to be connected to the carrier and the second fitting portion being configured to be connected to the furniture part;

a hinge mechanism for hingedly connecting the first fitting portion and the second fitting portion to one another, the hinge mechanism having at least five hinge axis members, wherein the hinge mechanism includes a supporting lever directly connecting the first fitting portion and the second fitting portion to one another, wherein the hinge mechanism includes a control mechanism for controlling a motion sequence between the first fitting portion and the second fitting portion, the control mechanism being a separate component from the supporting lever so as to not have a one-piece construction with the supporting lever, and the control mechanism having at least three control levers hingedly connected to one another, wherein the at least three control levers of the control mechanism include a first control lever connected to the first fitting portion via a hinge axis member, a second control lever connected to the second fitting portion via a hinge axis member, and a third control lever connecting the first control lever and the second control lever to one another, and wherein the first fitting portion and the second fitting portion of the furniture hinge are movably supported relative to one another between a first position, in which the at least one furniture part, in the mounted condition, is aligned substantial parallel to the sidewall and is displaceable, jointly with the carrier, in the depth direction of the furniture carcass, and a second position, in which the at least one furniture part, in the mounted condition, covers at least partially a front face of the sidewall.

12. An item of furniture comprising:

a furniture carcass;

a furniture part movable relative to the furniture carcass; and the guide system according to claim 11 for moving the movable furniture part relative to the furniture carcass.

13. The item of furniture according to claim 12, wherein the furniture part is a first furniture part of at least two furniture parts hingedly connected to one another by a hinge fitting, and each of the at least two two furniture parts are movably supported relative to the furniture carcass.

14. The item of furniture according to claim 13, wherein the first furniture part and a second furniture part of the at least two furniture parts are movably supported between a first position, in which the first furniture part and the second furniture part are aligned substantially coplanar to one another, and a second position, in which the first furniture part and the second furniture part are aligned substantially parallel to one another.

15. The item of furniture according to claim 12, wherein the control mechanism is configured such that the furniture part is movably supported between a first position, in which the furniture part is aligned substantially parallel to the sidewall of the furniture carcass, and a second position, in which the furniture part is aligned substantially perpendicular to the sidewall of the furniture carcass.

16. The item of furniture according to claim 15, wherein the furniture part, in the second position in which the furniture part is aligned substantially perpendicular to the sidewall of the furniture carcass, covers at least partially the front face of the sidewall.

17. The item of furniture according to claim 16, wherein the furniture part, in the second position in which the furniture part is aligned substantially perpendicular to the sidewall of the furniture carcass, covers substantially entirely the front face of the sidewall.

18. A furniture hinge comprising:

a first fitting portion configured to be fixed to a furniture part or configured to be fixed to a carrier movably-supported relative to a furniture carcass;

a second fitting portion configured to be fixed to a movably-supported furniture part;

a hinge mechanism for hingedly connecting the first fitting portion and the second fitting portion to one another, the hinge mechanism having at least five hinge axis members, wherein the hinge mechanism includes a supporting lever directly connecting the first fitting portion and the second fitting portion to one another, wherein the hinge mechanism includes a control mechanism for controlling a motion sequence between the first fitting portion and the second fitting portion, the control mechanism being a separate component from the supporting lever so as to not have a one-piece construction with the supporting lever, and the control mechanism having at least three control levers hingedly connected to one another, wherein the at least three control levers of the control mechanism include a first control lever connected to the first fitting portion via a hinge axis member, a second control lever connected to the second fitting portion via a hinge axis member, and a third control lever connecting the first control lever and the second control lever to one another, and wherein the supporting lever includes at least two partial levers which are spaced from one another along the hinge axis members.

19. The furniture hinge according to claim 18, wherein at least one of the control levers is at least partially arranged between the partial levers of the supporting lever, and/or at least one of the control levers includes at least two partial control levers spaced from one another along the hinge axis members.

20. The furniture hinge according to claim 19, wherein all of the at least three control levers are at least partially arranged between the partial levers of the supporting lever, and/or all of the at least three control levers include at least two partial control levers spaced from one another along the hinge axis members.

* * * * *